US007950067B2

(12) United States Patent
Williams, Jr.

(10) Patent No.: US 7,950,067 B2
(45) Date of Patent: May 31, 2011

(54) CLIP-ON PROTECTIVE KNEEPAD

(76) Inventor: James D. Williams, Jr., Homer, AK (US)

( * ) Notice: Subject to any disclaimer, the term of this patent is extended or adjusted under 35 U.S.C. 154(b) by 58 days.

(21) Appl. No.: 11/858,377

(22) Filed: Sep. 20, 2007

(65) Prior Publication Data

US 2008/0222767 A1 Sep. 18, 2008

Related U.S. Application Data

(60) Provisional application No. 60/846,660, filed on Sep. 22, 2006.

(51) Int. Cl.
*A41D 13/00* (2006.01)

(52) U.S. Cl. ..... 2/23

(58) Field of Classification Search ..... 2/22–24, 2/79, 227, 231, 16, 908, 911; 602/23, 26, 602/20

See application file for complete search history.

(56) References Cited

U.S. PATENT DOCUMENTS

| | | | | |
|---|---|---|---|---|
| 1,896,561 | A * | 2/1933 | William | 2/24 |
| 3,346,877 | A * | 10/1967 | Zirves | 2/24 |
| 5,405,312 | A * | 4/1995 | Jacobs | 602/5 |
| 5,557,804 | A * | 9/1996 | Ovortrup et al. | 2/23 |
| 5,732,412 | A * | 3/1998 | Holden | 2/23 |
| 6,347,403 | B1 * | 2/2002 | Wilcox | 2/23 |
| 6,654,960 | B2 * | 12/2003 | Cho | 2/22 |
| 6,704,938 | B2 * | 3/2004 | Crockett | 2/23 |
| 6,854,129 | B2 * | 2/2005 | Mazzarolo | 2/23 |
| 7,490,360 | B2 * | 2/2009 | Meadows | 2/23 |

* cited by examiner

*Primary Examiner* — Tejash Patel

(74) *Attorney, Agent, or Firm* — Webb IP Law Group; Jason P. Webb; Danny Y. H. Cheng

(57) ABSTRACT

A kneepad includes connectors (32 and 34) at its lower side edges (30 and 31) below the position of articulation of the joint. The connectors are biased toward a plurality of ribs (40) integrally formed in the external side surface of the outer hard shell (22) for trapping the side seams of the pant leg against the ribs and holding the kneepad firmly in place.

13 Claims, 7 Drawing Sheets

CLIP-ON PROTECTIVE KNEEPAD

CROSS REFERENCE TO RELATED FILE

Applicant claims the benefit of co-pending provisional patent application 60/846,660 filed Sep. 22, 2006.

FIELD OF THE INVENTION

This invention concerns protective pads worn on the body, such as kneepads, that are strapless, non-constricting and that attach to the pants legs of a wearer.

BACKGROUND OF THE INVENTION

Protective kneepads have been available for people to wear on their bodies, such as kneepads, elbow pads, shin pads, thigh pads, forearm pads, etc.

The pads protect the limbs of the body from injury and provide comfort to the wearer.

Some pads have straps that are connected to the edges of the pads and extend about the limb so as to have enough frictional contact to cling to the leg, arm, etc. Typically, the pads require upper and lower straps for connection to the limbs. For example, kneepads usually have upper straps to be wrapped from the upper portions of the kneepads around the legs above the knees and lower straps to be wrapped around the legs below the knees. If the straps are drawn tightly about the limb, they tend to hold the kneepad in place, but the tighter the straps the more constriction and discomfort there is about the limbs. This generates an undesirable constriction in the blood flow and discomfort to the wearer. Consequentially those who wear kneepads tend to attach the straps as loosely as possible in order to reduce the discomfort and as a result the kneepads have a propensity to slip out of position.

Also, when the wearer of kneepads is in the kneeling position, it is highly desirable to have the kneepads properly placed at the knee for maximum effect. However, when the wearer stands and the knee is straightened, the pants of the wearer become somewhat bunched above the kneepad, and there is some tendency of the kneepads to slip downwardly with the pants, to a position lower than the desired position. When the wearer returns to the kneeling position, the constriction of the straps tends to impede the lifting movement of the kneepads that is necessary to move the kneepads back up to the desired position at the knee. If the straps are tightly drawn to avoid downward movement of the kneepads when the wearer moves to the standing position, the pants of the wearer will remain bunched above the knee.

Similar problems are experienced with elbow pads and other pads that have straps that encircle the limbs of the body.

Other prior art pads utilize an attaching method other than straps that wrap around the entire leg in that they include shorter straps that do not extend about the limbs of the wearer but have connectors at the ends of the straps that connect directly to the pants of the wearer. For example, U.S. Pat. Nos. 6,988,281, 6,704,938, and 6,347,403 disclose kneepads and straps for kneepads, each with four straps, each strap extending from the sides of the kneepads and being individually connected to the pants leg of the wearer. The straps extend from the edges of the kneepad, with a connector at the distal ends of the straps extending farther away from the kneepad for grasping the pants of the wearer. The connectors are displaced substantially from the kneepad, providing the opportunity of the kneepad to sag downwardly from the connectors.

The upper pair of straps is attached above the knee and the lower pair of straps is attached below the knee, all being attached to the pants without encircling the leg of the wearer. The placement of the fasteners at the distal ends of the straps may form the desired loose connection of the straps to the pants legs but tends to allow the pads to sag downwardly and away from the pants legs so that the kneepads are not accurately held in the position for registering with the knees when the wearer kneels.

SUMMARY OF THE INVENTION

Briefly described, the present invention comprises a protective pad for the limbs of a person that connects to the clothing of the person, particularly when the person expects to encounter abrasion, impact, weight or other discomfort to the limb. The invention may be designed and used for the arms or legs of the body. The embodiment of the invention disclosed herein is for protection of the knees, but the product may be formed for other parts of the body.

The protective kneepads include connectors integrated into the side edges of the pads and directly connect the kneepads to the pants of the wearer. No straps are required to extend from the kneepad to the connectors. The connectors are configured to gather and connect to the material of the pant legs with the gathered material extending at the side edges of the kneepad. This tends to minimize any looseness of the connection to the pant legs, and minimize any "droop" of the kneepad from the pant legs.

In one form of the invention a protective kneepad is provided for attachment to a pant leg. The kneepad includes a protective shell including a convex outer surface and a concave inner surface and opposite edges. Connectors are integrated into the opposite edges of the protective shell and are configured to connect pant legs against said kneepad. The opposite edges of the protective shell each may include at least one rib, and the connectors are configured to trap a portion of a pant leg against one of said ribs of the protective shell.

In one form, the invention includes a protective pad for attachment to a garment, including protective shell with a convex outer surface and a concave inner surface and opposite edges, a layer of material softer than the protective shell is in contact with the inner and outer surfaces of the protective shell, and connectors are integrated into the opposite edges of the protective shell and are configured to connect pant legs against the pad.

The protective pad may include a protective shell with an array of openings extending there through, and soft material may be applied to both the inner and outer surfaces of the protective shell and extend through the array of openings and may uniformly cover at least a majority of the surfaces of the protective shell.

The protective shell may include shell ribs at its opposite edges, and the connectors are urged toward engagement with the shell ribs of the protective shell, such that the connectors urge garment material of the wearer of the protective pad into engagement with the shell ribs for supporting the protective pad from the garment material.

Also, the connectors may include connector ribs for inner-engagement with the shell ribs, with the pant leg material trapped between the connector ribs and shell ribs.

Preferably, the connectors of the protective pad are mounted to the pads at approximately one-half the height of the pads, below the position where the joint of the wearer articulates, allowing only two connectors to function to adequately and firmly hold the pads in place. The connectors are arranged so that the bottom portion of the pads generally tend to rest against the lower limb, such as the shin below the knee, whereas the upper portion of the pad extends to a point just above the kneecap. With this configuration, when the wearer of a kneepad is in the kneeling position, the upper portion of the kneepad will project outwardly under the knee, out toward the front of the wearer, thus providing cushioning for the kneecap, while the lower portion is beneath the knee, protecting the shin. When the wearer kneels, walks or stands the upper portion of the kneepad and the thigh at the knee tend to move independently so that the upper portion of the kneepad is not an obstruction to the movement of the leg.

In other preferred embodiments, two pairs of connectors may be mounted to the sides of the kneepads, a lower pair positioned at the lower opposite side of the edges of the kneepad and a mid-height pair positioned about one-half the height of the side edges of the kneepad. The mid-height pair of connectors may be connected to the pant legs at or just below the position of articulation of the knee of the wearer.

Preferably the connectors of the kneepads are integrated into the kneepad at a location on the surface of the kneepad, so that the connectors do not require a strap or other means for connection to the kneepads. This assures firm connections between the side edges of the kneepads and the pant legs, so that the kneepads tend to maintain a firm position at the knees of the wearer.

In one form of the invention, the connectors are integrated into the outside surface of the kneepads, and in another form the connectors are positioned on the inside surface of the kneepads. This contributes to the firm connection of the kneepad to the pant leg, avoiding dangling straps as a way of connecting the kneepads to the pant legs.

Preferably, the connectors are located so as to be connected to the vertical side seams of the pant leg, which tends to be the strongest and most durable portion of a typical pant leg. Typically, when the kneepads are fastened to the pant legs and the wearer stands upright with straight legs, the wearer is likely not to be aware of the presence of the kneepads since there are no straps that encircle the legs of the wearer and the kneepads tend to not droop as much as if connected by straps. This tends to minimize the discomfort of a constricting strap connector used by prior art kneepads. Moreover, the firm connection made by the connectors at the edges of the kneepads tends to have the kneepads move in unison with the pant leg during body motions.

Preferably, the kneepad structure has a protective shell with layers of softer material adhered to either the inner surface and/or to the outer surface of the protective shell, with the layers being formed of softer material than the protective shell. The layers of soft material may be made of various materials, such as foam rubber, various forms of soft plastics, such as thermoplastic elastomer, cotton batten, quilted cotton batten, and other suitable materials. The protective shell of the kneepad may be made of a harder material such as thermoplastic urethane, polypropylene or various other rigid yet flexible materials.

Another form of the invention may be that the protective shell has an array of openings formed there through, and the soft material of the kneepad extends through the openings of the protective shell. This provides more flexibility of the harder protective shell, and the outer layer of the soft material, when made of a plastic foam, tends to provide extra sliding friction when the kneepad engages a hard surface such as a wooden floor surface.

If desired, the kneepads may be formed in a concave shape so as to extend generally about the knees so that the kneepads tend to find their own positions about the knees when the wearer moves to the kneeling position. Also, the kneepads may have a hard exterior and a soft liner for more comfort and protection.

DETAILED DESCRIPTION

Figure 1:
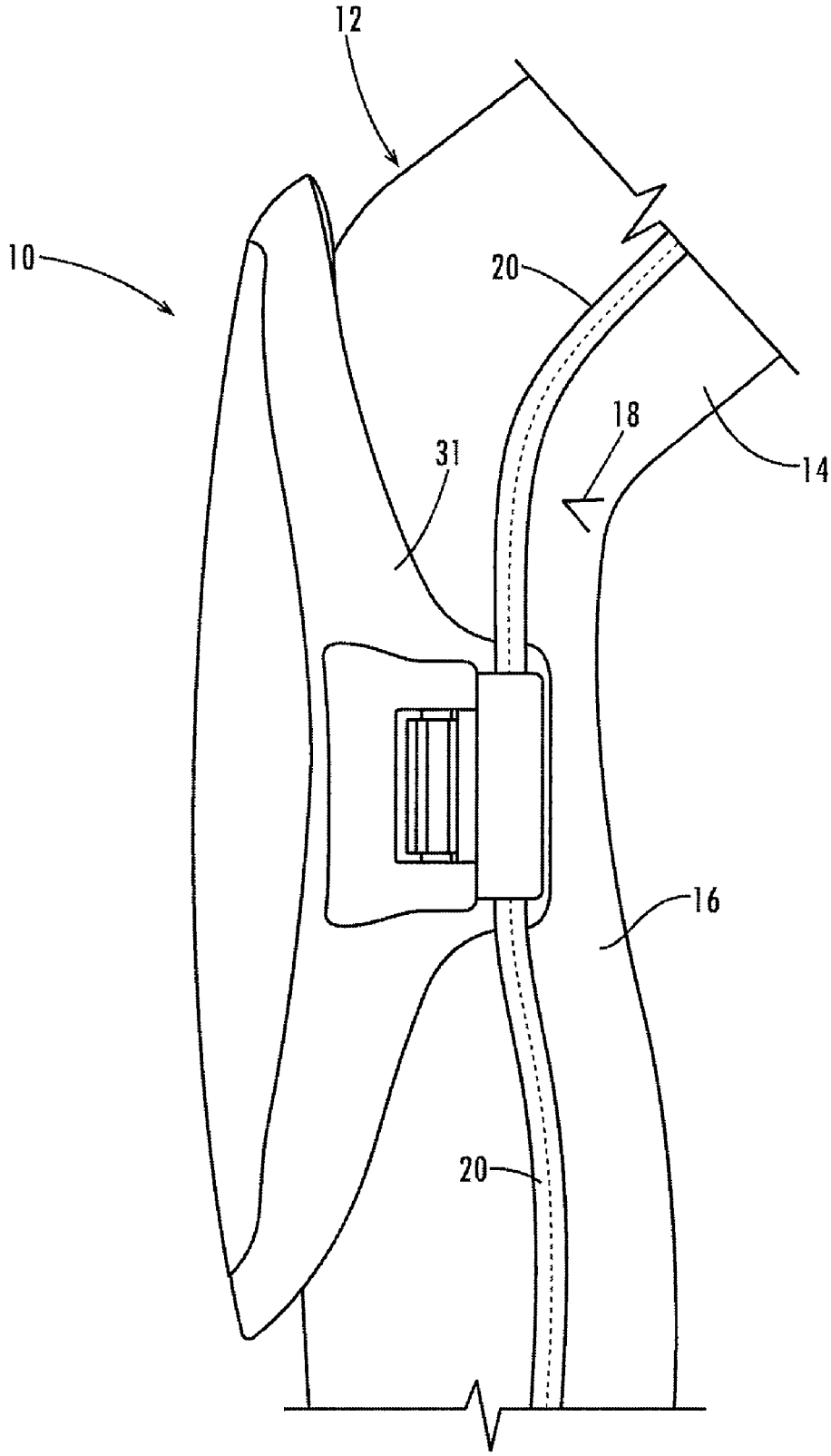
FIG. 1 is a side elevational view of a kneepad as it is mounted to a pant leg of a wearer who is in a crouched position.

Referring now in more detail to the drawings, in which like numerals indicate like parts throughout the several views, FIG. 1 illustrates a kneepad 10 for connection to the pant leg 12 of a wearer of the pant leg. The pant leg and the wearer have a thigh 14, a calf 16, and a knee that is between the thigh and calf, with position of articulation of the knee indicated at the back of the knee 18 shown behind the kneepad 10. The pant leg may include vertical seams, such as seam 20, and the kneepad 10 typically is connected to the seams of the pant leg.

Figure 2:
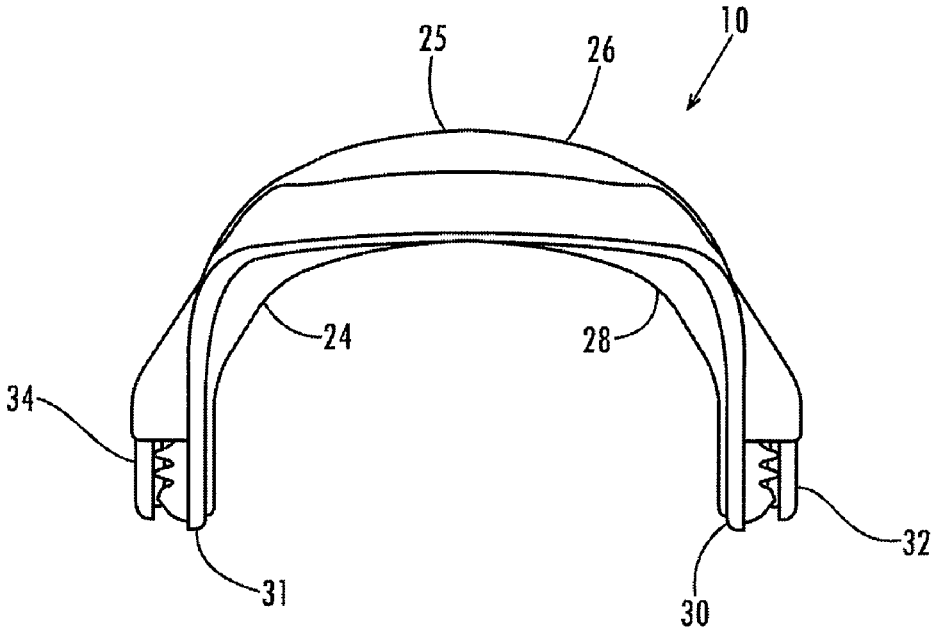
FIG. 2 is a top view of the kneepad.
Figure 3:
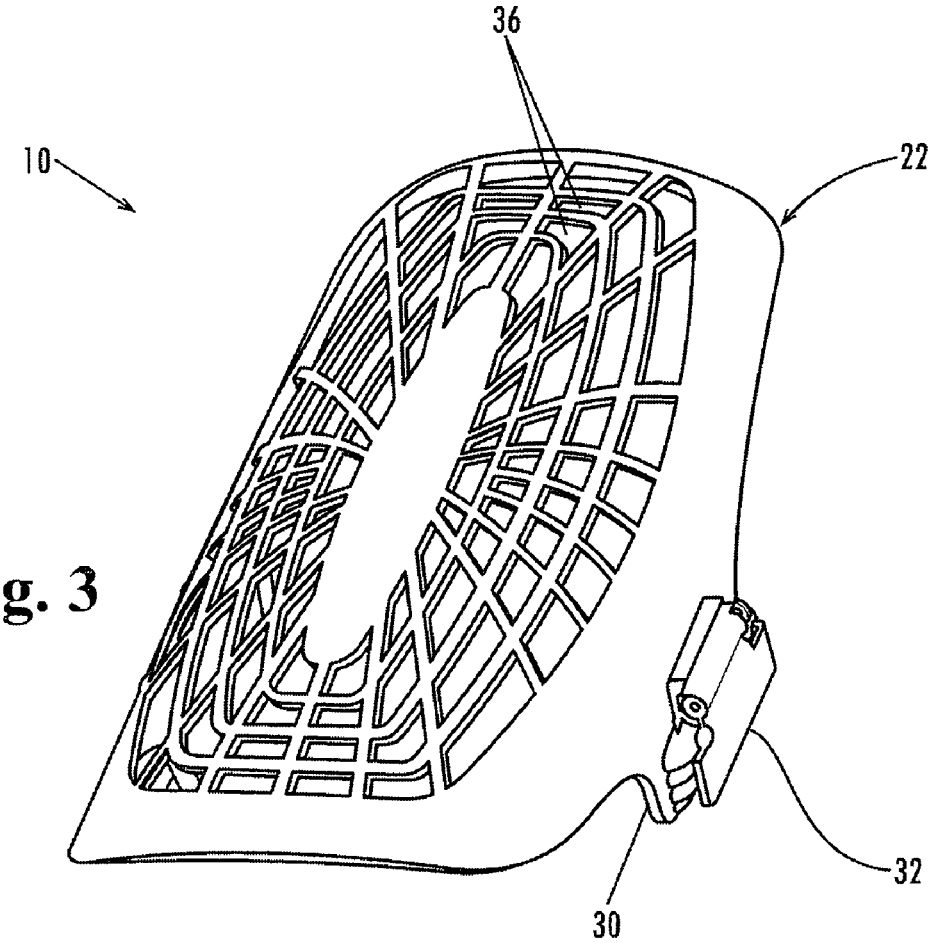
FIG. 3 is a perspective view of the protective shell of the kneepad.
Figure 4:
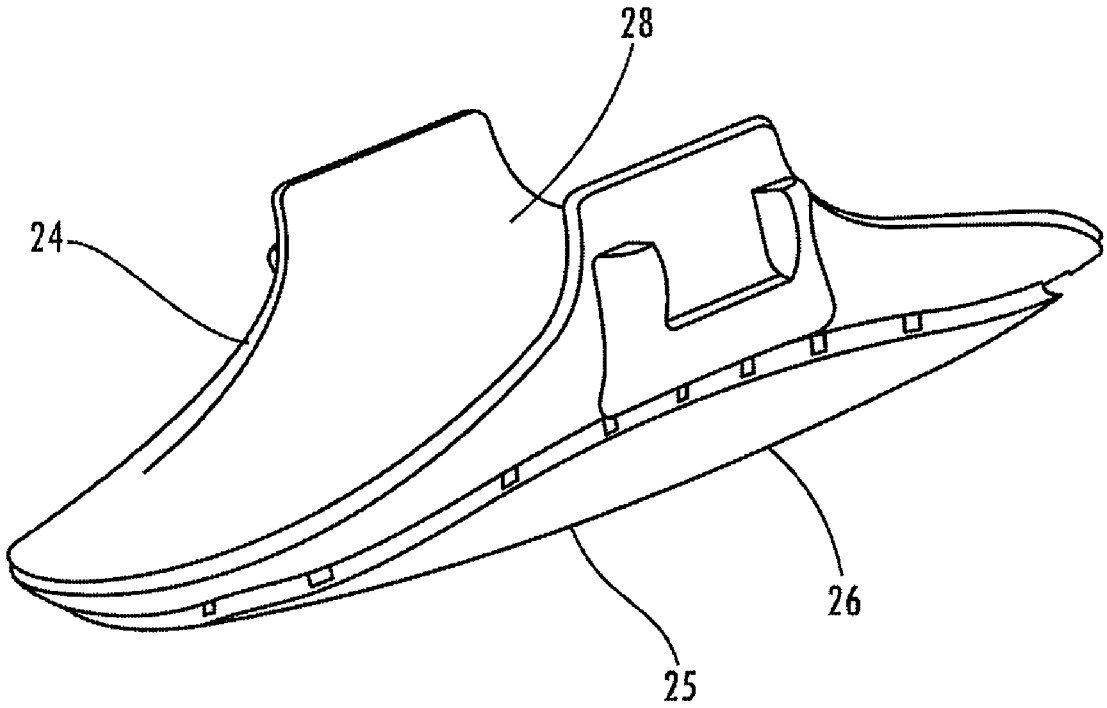
FIG. 4 is a perspective view of the kneepad with outer soft material with the protective shell and the connectors removed.

As shown in FIG. 3, the kneepad 10 includes an protective hard shell 22. As shown in FIG. 2 the kneepad has inner and outer layers of soft material 24 and 25 applied to the inner protective shell. The protective shell may be made of a hard yet flexible plastic such as a thermoplastic urethane, polyurethane, polyvinylchloride, polypropylene or other suitable similar compound and the softer material applied to the protective shell may be made of a thermoplastic elastomer or a foam rubber or other relatively soft material.

The protective shell and the softer material applied to the protective shell have a convex outer surface and a concave inner surface. The protective shell and its layers of soft material have a convex surface 26 for engagement with the ground, floor, etc., and the inner softer layer of material has a concave surface 28 for engagement by the knee of the wearer of the kneepad. The protective hard shell 22 includes opposed side edge portions 30 and 31 for extending adjacent the opposite sides of the knee of the wearer, and connectors 32 and 34 are integrated into the opposed side edge portions 30 and 31.

As best shown in FIG. 3, the protective hard shell 22 has an array of openings such as openings 36 formed there through. The inner soft layer 24 and outer soft layer 25 extend through the at least some of the array of openings and lock to each other to maintain connection to each other. The softer outer layer provides a surface that may bear against the floor, ground, or other surface on which the kneepad is engaged and may tend to apply friction against the floor, etc., tending to avoid inadvertent sliding of the kneepad on the floor.

Figure 5:
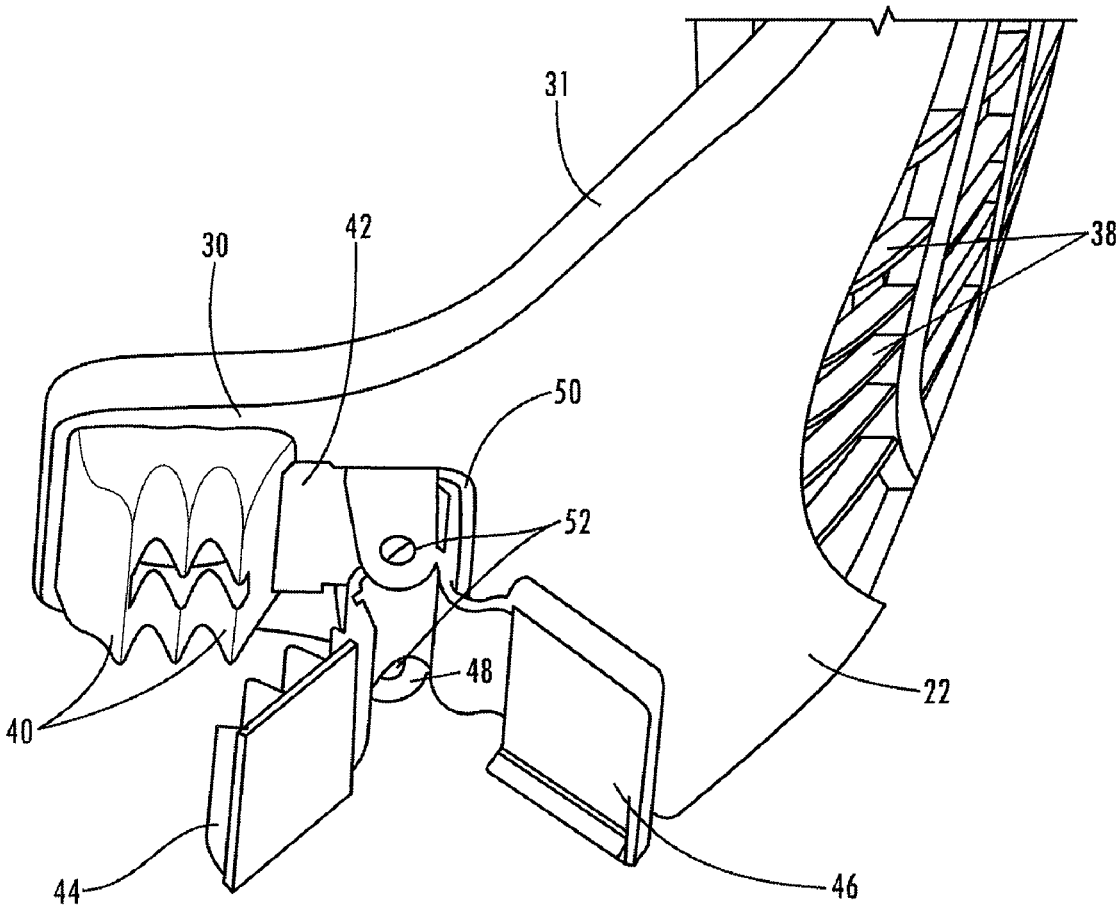
FIG. 5 is a detailed illustration of a connector that is integrated into the protective shell of the kneepad.
Figure 6:
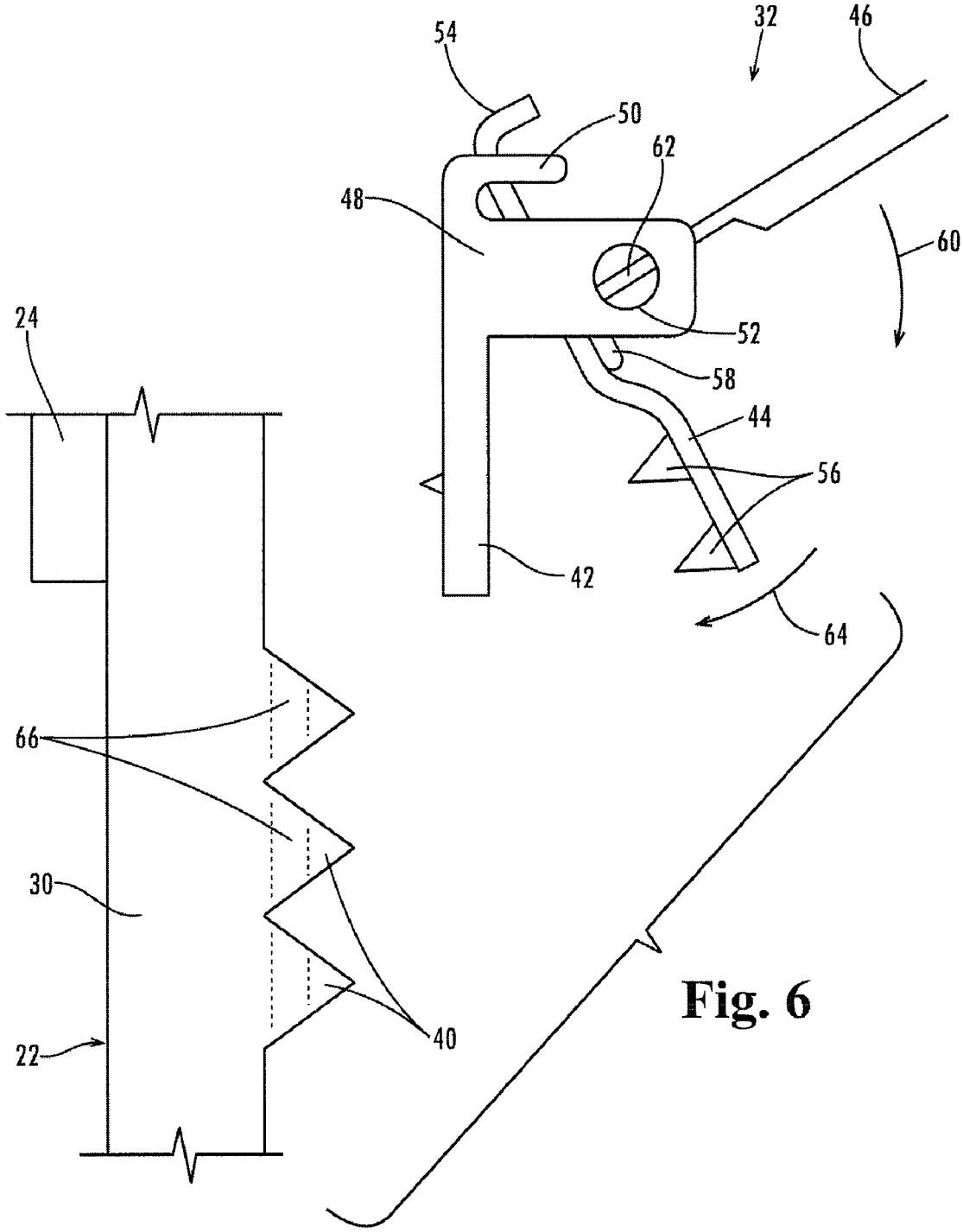
FIG. 6 is an expanded top view of a connector, showing how the connector is intrgrated into the protective shell of the kneepad.

As shown in FIGS. 2, 5 and 6, the opposed side edge portions 30 and 31 of the protective shell include at least one protrusion 40 that extends from the protective surface of the protective hard shell 22. Preferably, the protrusion 40 will comprise a plurality of ribs, such as three ribs. As shown in FIG. 6, the connectors 32 and 34 each include three connector leaves, mounting leaf 42, locking leaf 44, and lever leaf 46. Mounting leaf 42 includes a pair of opposed support arms 48 that form a U-shape with the mounting leaf 42 and an upper extension 50. The pair of support arms 48 defines aligned openings 52.

Locking leaf 44 includes an upper angle tang 54 that extends through an opening (not shown) of the upper extension 50 of the mounting leaf 42, and the lower portion of the locking leaf includes at least one rib 56.

Lever leaf 46 has a tang 58 that pivots with the lever in the direction as indicated by arrow 60, and side pins 62 that engage in the pair of aligned openings 52. When the lever leaf is pivoted in the direction of arrow 60, its tang 58 engages and pivots locking leaf 44 in the direction as indicated by arrow 64 so that the ribs 56 move toward mounting leaf 42.

As illustrated in FIG. 6, the ribs 40 of the opposed side edge portions 30 and 31 of the protective hard shell 22 have a slot formed therein at 66. The slot is sized and shaped to receive the lower portion of the mounting leaf 42 so that the connectors 32 and 34 are integrally received and permanently engaged in the slots 66 with the ribs 56 of the connectors facing the ribs 40 of the protective hard shell 22. Therefore, when the lever leaf 46 of a connector is tilted in the direction indicated by arrow 60 of FIG. 6, the ribs 56 of the connector will move toward engagement with the ribs 40 of the protective hard shell. If a portion of a pant leg is positioned between the ribs 40 and 56, the connector will be attached to the pant leg, as shown in FIG. 1.

While a specific connector has been illustrated and described herein, other types of connectors may be employed as may be desired.

As shown in FIG. 3, the protective hard shell 22 has been described and illustrated as having an array of openings therein. However, the kneepad may be constructed with no openings, or with a different array of openings, as may be desired.

Figure 7:
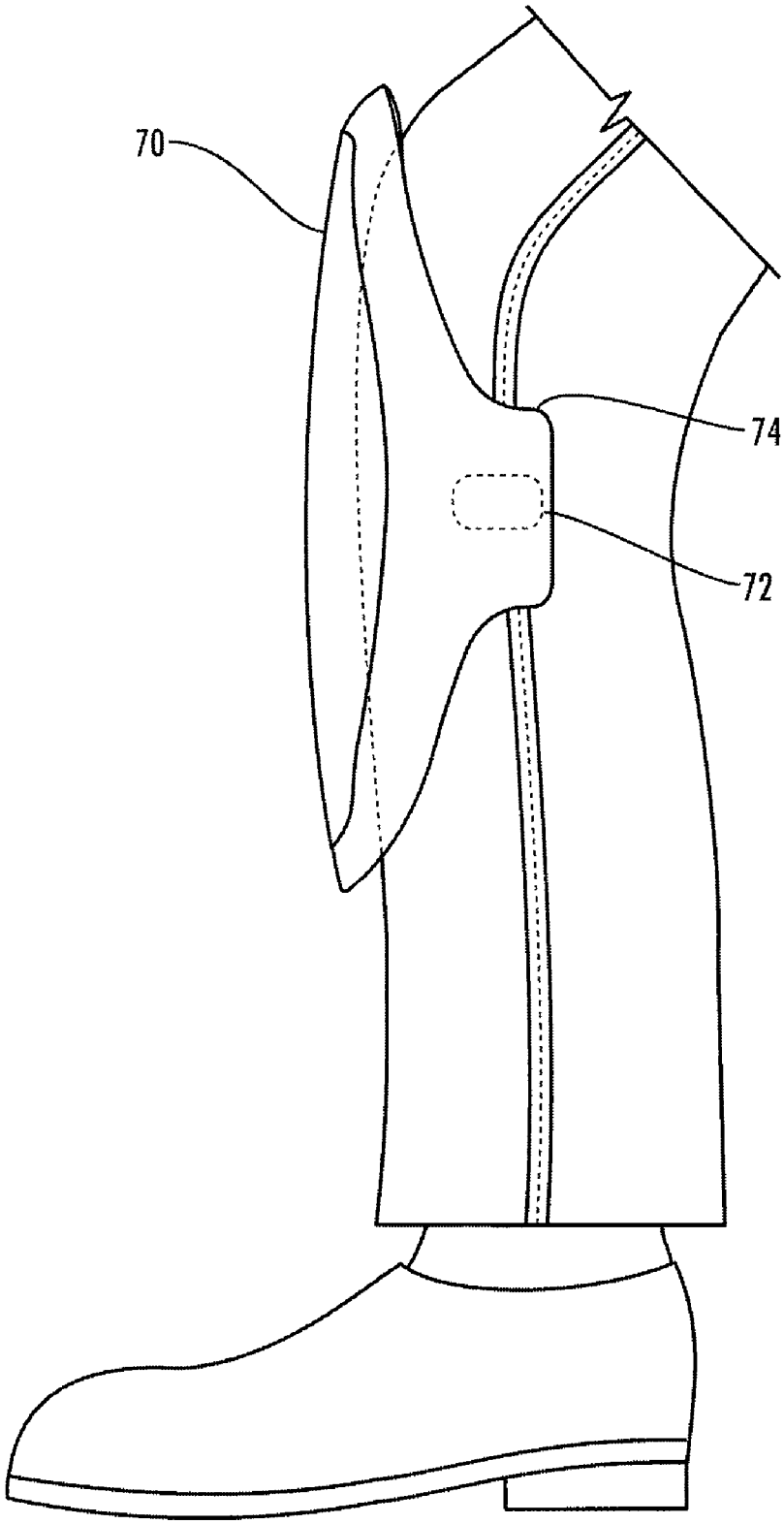
FIG. 7 is a side view of another embodiment of the invention, showing the kneepad connected to the pant leg of the wearer.
Figure 8:
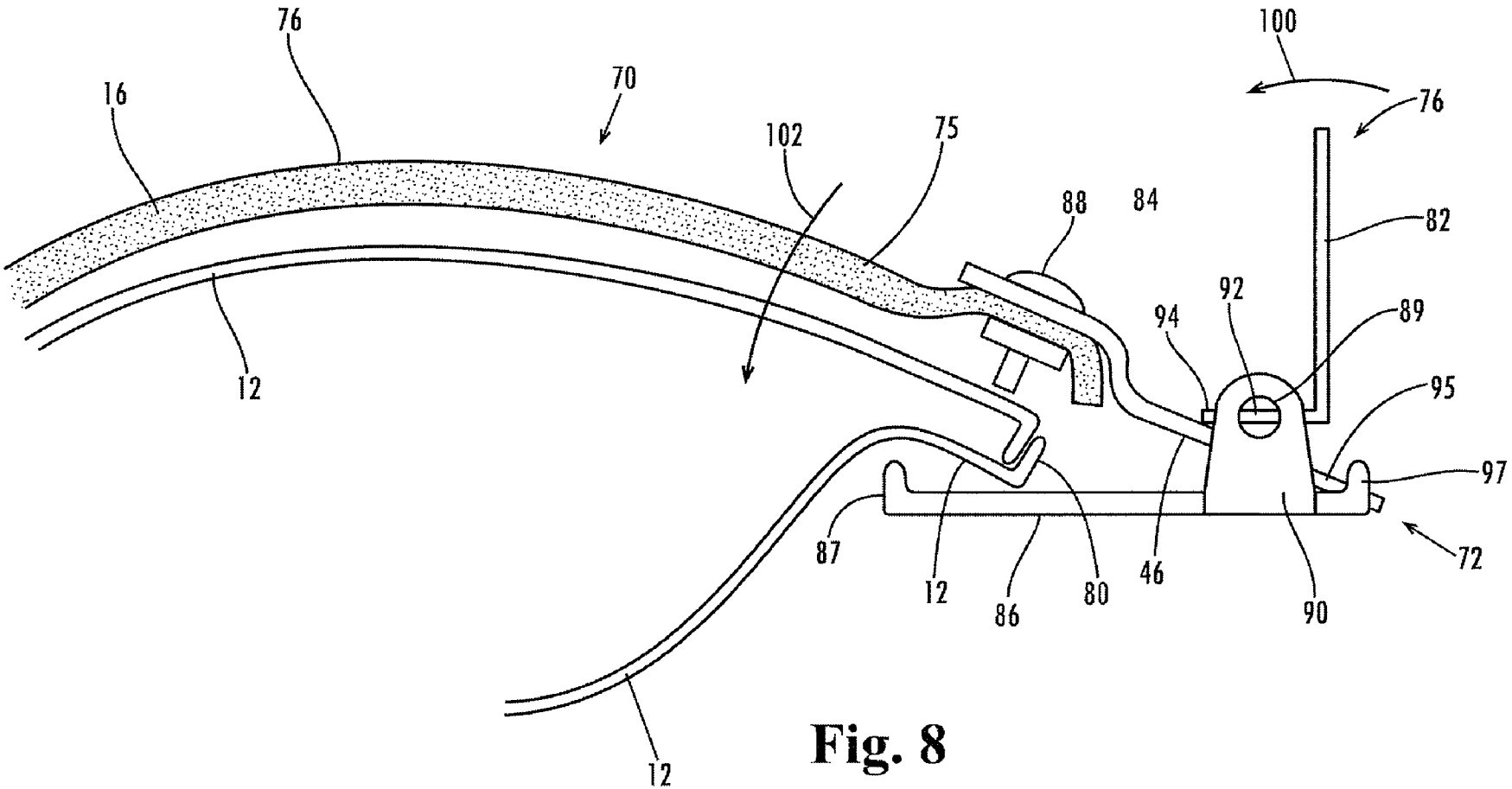
FIG. 8 is a detailed illustration of the modified connector used for the connection of the kneepad of FIG. 7 to the pant leg.

While the foregoing description concerns a kneepad having connectors for engaging a pant leg against ribs formed on the opposed side edge portions 30 and 31 of an protective hard shell 22, other types of connections may be made. For example, it is desirable that the kneepad be connected directly to the pant leg instead of having an intermediate strap that leads from the kneepad to a connector, so as to minimize the relative movement experienced between the kneepad and the pant leg and the knee of the wearer. To fulfill this function, FIGS. 7 and 8 illustrate a kneepad 70, similar to that of the previous figures, but including a different type of connector. Connectors 72 are applied to the opposed side edge portions of the protective shell, such as edge portion 75, with only one pair of connectors being necessary.

As best illustrated in FIG. 8, the connectors 76 each include three connector leaves, outer connector leaf 82, intermediate connector leaf 84, and inner connector leaf 86. Inner connector leaf 86 includes a saw-tooth distal edge 87 for grasping the pants leg material. All three connector leaves 82, 84 and 86 are hingedly connected to one another at their proximal ends. Rivet 88 extends through intermediate connector leaf 84 and through the edge 75 of the pad 76 so as to permanently and integrally connect the material of the kneepad to the connector.

The outer leaf 82 is pivoted at its proximal end within the openings 89 in the ears 90 of inner leaf 86, with the tabs 92 extending laterally from the outer leaf 82 through the openings 89. Intermediate leaf has laterally extending tabs 95 at its proximal end that are captured by the ears 90 and the angled proximal end 97 of inner leaf 86 so that the intermediate leaf pivots about its tabs 95. The proximal end 94 of the outer leaf 82 is formed at an angle with respect to its distal end and when the distal end of the outer leaf is moved toward its closed position as indicated by arrow 100, the angled proximal end 94 engages the proximal end 96 of the intermediate leaf 84. This applies a biasing force to the intermediate leaf 84, tending to pivot it as indicated by arrow 102 toward a firmly closed position against inner leaf 86.

As shown in FIG. 8, the kneepads 70 may be attached to the pants legs 12 of the wearer by opening the outer leaf 82 away from the intermediate leaf 84. The wearer of the pants pulls the pants material 12 into the gap between the intermediate leaf 84 and the inner leaf 86, preferably with a side seam 80 of the pants leg being moved between the connector leaves. The outer connector leaf 82 is then pivoted toward its closed position as indicated by arrow 100. Its angled proximal end acts as a cam against the proximal end of the intermediate leaf to bias the intermediate leaf in the direction of arrow 102 against the pants leg so as to grip the pants leg about its side seam. When the angled proximal edge 94 of the outer leaf 82 passes beyond its bottom dead center with respect to intermediate leaf 84, the spring force of the intermediate leaf applied to the angled proximal end 94 of the outer leaf retains the outer leaf closed and the intermediate leaf is biased against the material of the pad, thus locking the connector to the pants leg.

Although preferred embodiments of the invention have been disclosed in detail herein, it will be obvious to those skilled in the art that variations and modifications of the disclosed embodiments can be made without departing from the spirit and scope of the invention as set forth in the following claims.

The invention claimed is:

1. A protective kneepad for attachment to a pant leg comprising:

a protective shell including a convex outer surface and an concave inner surface and opposite ends, and connectors integrated into opposite ends of said protective shell configured to trap the pant leg against said protective shell;

wherein said protective shell includes a plurality of shell ribs integrally protruding from an outer surface of said opposite ends of said protective shell and extending therefrom wherein the connectors include means aligned with said ribs for urging said connectors toward engagement with said ribs such that the connectors urge pant leg material of the wearer of the protective kneepad into engagement with the ribs for supporting the protective kneepad on the pant leg material.

2. The protective kneepad of claim 1, wherein there are no straps between the connectors and the protective shell.

3. A protective kneepad for attachment to a pant leg comprising:

a protective shell including a convex outer surface and an concave inner surface and opposite ends, and connectors integrated into opposite ends of said protective shell configured to trap the pant leg against said protective shell; wherein said protective shell includes integral protrusions extending from the outer shell of the kneepad at a pair of side edges and said connectors engage against said protrusions.

4. The protective kneepad of claim 3, wherein said connectors extend in overlying relationships with said protrusions.

5. The protective kneepad of claim 3, wherein said protrusions include shell ribs and said connectors include connector ribs for the inner-engagement with said shell ribs.

6. A protective kneepad for attachment to a pant leg comprising:

a protective shell including a convex outer surface and a concave inner surface and opposite edges, connectors integrated substantially inward from opposite edges of said protective shell configured to connect bare pant leg against said protective shell; wherein said opposite edges of said protective shell each include at least an integral rib extending from the outer surface, said connectors are attached to said opposite edges of said protective shell and each said connector is configured to trap a portion of a pant leg against one of the ribs of said protective shell.

7. The protective kneepad of claim 6, wherein said connectors are attached to the outer surface of said protective shell.

8. The protective kneepad of claim 2, wherein the protective shell includes an opposed side edge portion configured to cooperate with the connector to grip material therebetween when clasped together.

9. The protective kneepad of claim 6, wherein said connector includes at least one connector rib for trapping a pant leg against one of the ribs of the of said protective shell.

10. The protective kneepad of claim 6, wherein said connectors are positioned to engage the pant leg below the position of articulation of the knee of the wearer of the pant leg.

11. The protective kneepad of claim 6, wherein at least on pair of said connectors are positioned to engage the pant leg below the position of articulation of the knee of the wearer of the pant leg.

12. The protective kneepad of claim 1, wherein the connectors are integrated substantially inward from a pair of opposite edges.

13. The protective kneepad of claim 3, wherein the connectors are integrated substantially inward from a pair of opposite edges.

* * * * *